US006662372B2

(12) United States Patent
Lewis et al.

(10) Patent No.: US 6,662,372 B2
(45) Date of Patent: Dec. 16, 2003

(54) COAT AND HARNESS COMBINATION

(75) Inventors: Patricia Lewis, Huber Heights, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 11 days.

(21) Appl. No.: 10/151,421

(22) Filed: May 17, 2002

(65) Prior Publication Data

US 2003/0213043 A1 Nov. 20, 2003

(51) Int. Cl.[7] ..... A62B 35/00
(52) U.S. Cl. ..... 2/69; 2/81; 2/94; 182/3
(58) Field of Search ..... 2/102, 44, 69, 2/93, 94, 79, 108, 85, 227, 300, 311, 312, 254, 69.5; 119/770; 128/846, 874, 875; 182/3, 4; 244/151 R

(56) References Cited

U.S. PATENT DOCUMENTS 2,979,153 A * 4/1961 Hoagland et al. ..... 182/3
4,731,882 A * 3/1988 Ekman ..... 2/69
5,036,548 A * 8/1991 Grilliot et al. ..... 2/81
5,136,724 A 8/1992 Grilliot et al.
5,970,517 A * 10/1999 Jordan ..... 2/69
6,134,713 A * 10/2000 De Rosa et al. ..... 2/94
RE37,394 E * 10/2001 Woodyard ..... 2/102

OTHER PUBLICATIONS

Black–and–white prints of four digital photographs of a vest and harness combination sold by North Safety Products of Cranston, Rhode Island, and admitted to constitute prior art.

* cited by examiner

*Primary Examiner*—Tejash Patel
(74) *Attorney, Agent, or Firm*—Wood, Phillips, Katz, Clark & Mortimer

(57) ABSTRACT

In a coat and harness combination for an emergency care worker, for a rescue worker, or for a firefighter, in which the coat has a thigh strap pocket and two side pockets and the harness has two thigh straps, each thigh strap having a first end, at which it is attached permanently to other portions of the harness, and a second end, at which it is attachable detachably to other portions of the harness, via a connector on such thigh strap and an interfitting connector, which is stowable in one of the side pockets when such thigh strap is not attached at its second end. While not attached at their second ends, the thigh straps are stowable removably in the thigh strap pocket. The coat has a flap having a first edge and a second edge, the flap being foldable along the first edge to close the thigh strap pocket and to open the thigh strap pocket, the second edge being attachable detachably to a rear portion of the coat, via hook-and-loop fasteners.

5 Claims, 5 Drawing Sheets

COAT AND HARNESS COMBINATION

TECHNICAL FIELD OF THE INVENTION

This invention pertains to a coat, such as a coat for an emergency care provider, for a rescue worker, or for a firefighter, which is combined with a harness. The harness has two leg straps, which are stowable in a leg strap pocket of the coat, when the leg straps are not deployed.

BACKGROUND OF THE INVENTION

Commonly, a firefighter fighting a fire in a tall building not only wears protective clothing, such as a turnout coat and bunker pants, but also wears a harness, which the firefighter can use, along with a rope or ropes, to descend from an unsafe situation.

As exemplified in U.S. Pat. Nos. 5,136,724 and 5,036,548, the disclosures of which are incorporated herein by reference, it has been known to combine firefighter's pants (trousers) and a harness, which a firefighter can don together. The harness has two leg straps, which are deployed between and around a wearer's thighs whenever the pants (trousers) and the harness are worn.

SUMMARY OF THE INVENTION

This invention provides a coat and harness combination comprising a coat, which has a leg strap pocket, and a harness, which has two leg straps. This invention does not require the leg straps to be always deployed between and around a wearer's thighs whenever the provided combination is worn. Rather, this invention enables the leg straps to be removably stowed in the thigh strap pocket, until such time as the wearer decides to remove the thigh straps and to deploy the thigh straps between and around the wearer's thighs, whereby to prepare to use the harness.

Each thigh strap has a first end, at which said thigh strap is attached permanently to other portions of the harness, preferably at a rear portion of the firefighter's coat and harness combination. Each thigh strap has a second end, at which said thigh strap is attachable detachably to other portions of the harness, preferably at a front portion of the provided combination. The thigh straps, while detached at their second ends are stowable removably in the thigh strap pocket, preferably at a rear portion of the provided combination.

Moreover, the thighs straps, when removed from the thigh strap pocket, are attachable detachably at their second ends to other portions of the harness. Preferably, the thighs straps are attached detachably at their second ends to those portions of the harness, via a connector on each thigh strap and a connector interfitting with the connector on said thigh strap. Preferably, moreover, the connectors that interfit with the connectors on the thigh straps are stowable in the side pockets when the thigh straps are not attached at their second ends.

Preferably, the coat has a flap having a first edge and a second edge. The flap is foldable along the first edge to close the thigh strap pocket and to open the thigh strap pocket. The second edge is attachable detachably to a rear portion of the coat, above the first edge, when the thigh strap pocket is closed, preferably via hook-and-loop fastening means.

The coat and harness combination provided by this invention can be advantageously worn by an emergency care worker, by a rescue worker, or by a firefighter.

BRIEF DESCRIPTION OF THE DRAWINGS

In FIG. 1, two thigh straps of the harness are stowed in a thigh strap pocket of the firefighter's coat.

In FIG. 2, a wearer is suggested in broken lines.

DETAILED DESCRIPTION OF THE ILLUSTRATED EMBODIMENT

Figure 1:
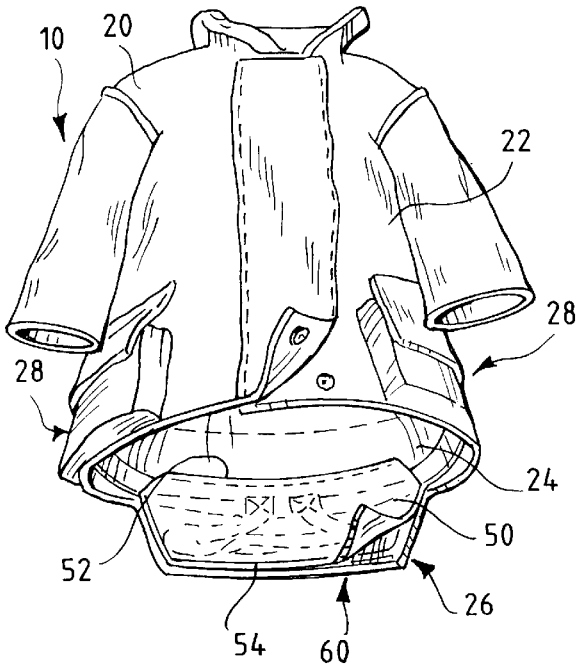
FIG. 1 is a perspective view of a coat and harness combination embodying this invention, as viewed from a front lower vantage.
Figure 2:
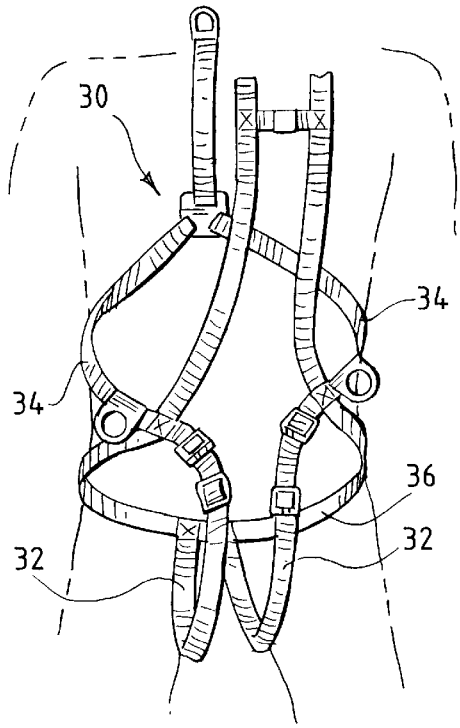
FIG. 2 is a perspective view of the harness, apart from the coat.

As illustrated in FIGS. 1, 2, and,3 and in other views, a coat and harness combination 10 embodying this invention combines a coat 20 and a harness 30. The coat 20 has a conventional construction except as illustrated and described herein, and has an outer, abrasion-resistant layer 22 and inner, moisture-resistant and thermally insulative layers 24. The coat 20 has a thigh strap pocket 26, which is novel, and two side pockets 28. The harness 30has a conventional construction, except as illustrated and described herein, and has plural straps made of a suitable, woven material, such as nylon. Except as illustrated and described herein, particulars of the coat 20 and particulars of the harness 30 are outside the scope of this invention.

Those straps include two thigh straps 32, which when the harness 30 is being used are deployed between and around a wearer's thighs and are attached detachably to two side straps 34 of the harness 30, via connectors 38 on the thigh straps 32 and connectors 40 on the side straps 40. Those straps include a buttocks-encircling strap 36, which when the harness 30 is being used encircles a wearer's buttocks. As contemplated by this invention, the thigh straps 32 are stowable in a thigh strap pocket 26 of the coat 20, when the thigh straps 32 are not deployed, and the connectors 40 are stowable in the side pockets 28 when the thigh straps 32 are not attached to the connectors 40.

Figure 8:
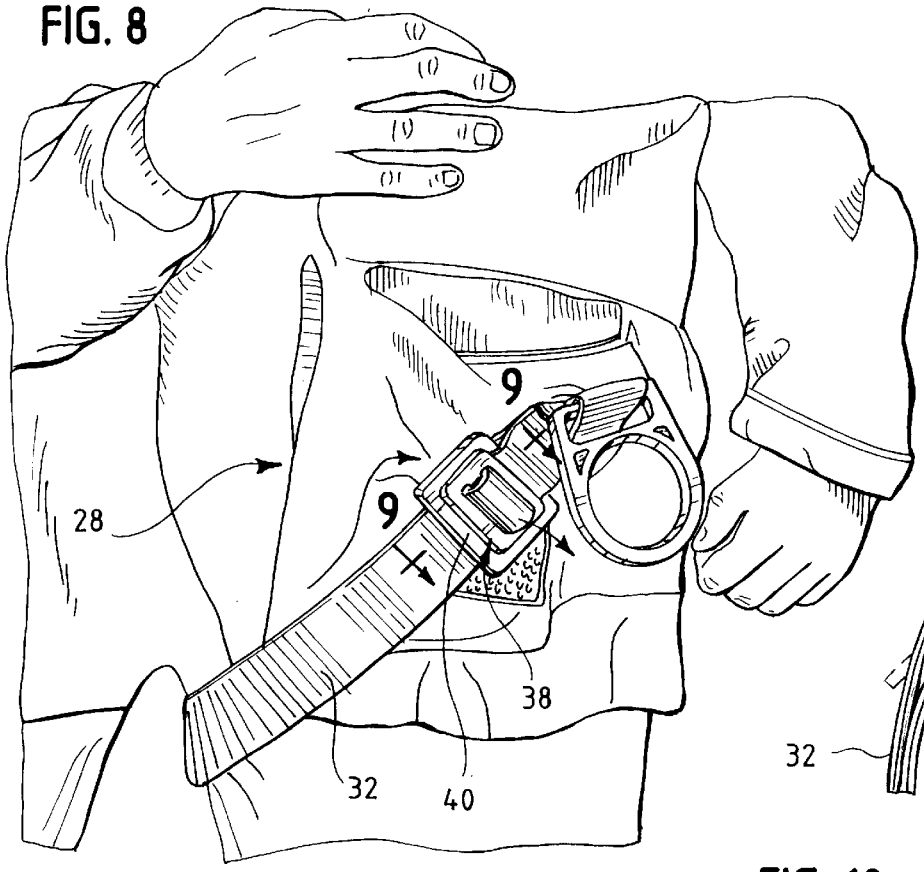
FIGS. 8 and 10, on a larger scale compared to FIGS. 4 through 7, are fragmentary, perspective views of the thigh straps, as attached detachably to the connectors.
Figure 9:
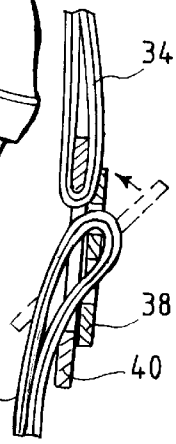
FIG. 9 is a cross-sectional detail, as taken along line 9—9 in FIG. 8, in a direction indicated by arrows.
Figure 10:
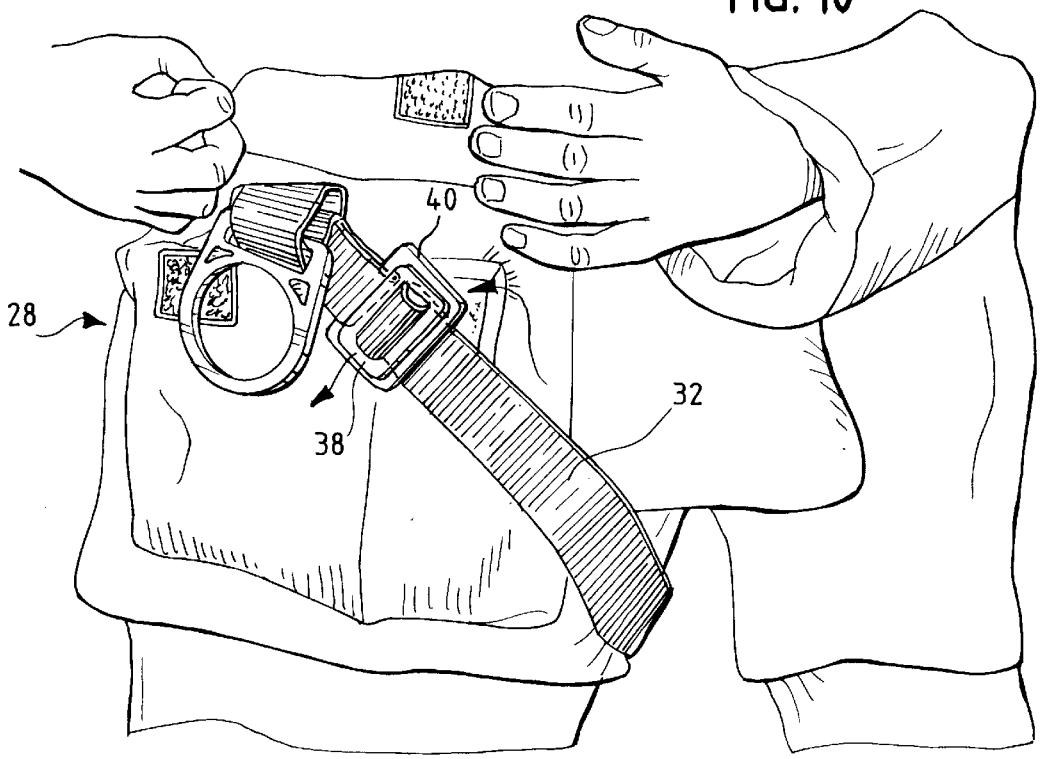

Each thigh strap 32 has a first end 42, at which said thigh strap 32 is sewn so as to be permanently attached to the buttocks encircling strap 44, at a rear portion of the coat 20. Each thigh strap 32 has a second end 46, at which said thigh strap 32 is attachable detachably to an associated one of the side straps 34, at a front portion of the coat 20, via an associated one of the connectors 38 and an associated one of the connectors 40. The connectors 38, 40, which are used conventionally in harnesses, are held on the respective straps in a known manner and interfit in a known manner, as illustrated in FIGS. 8, 9, and 10. Particulars of the connectors 38, 40, are outside the scope of this invention.

Figure 3:
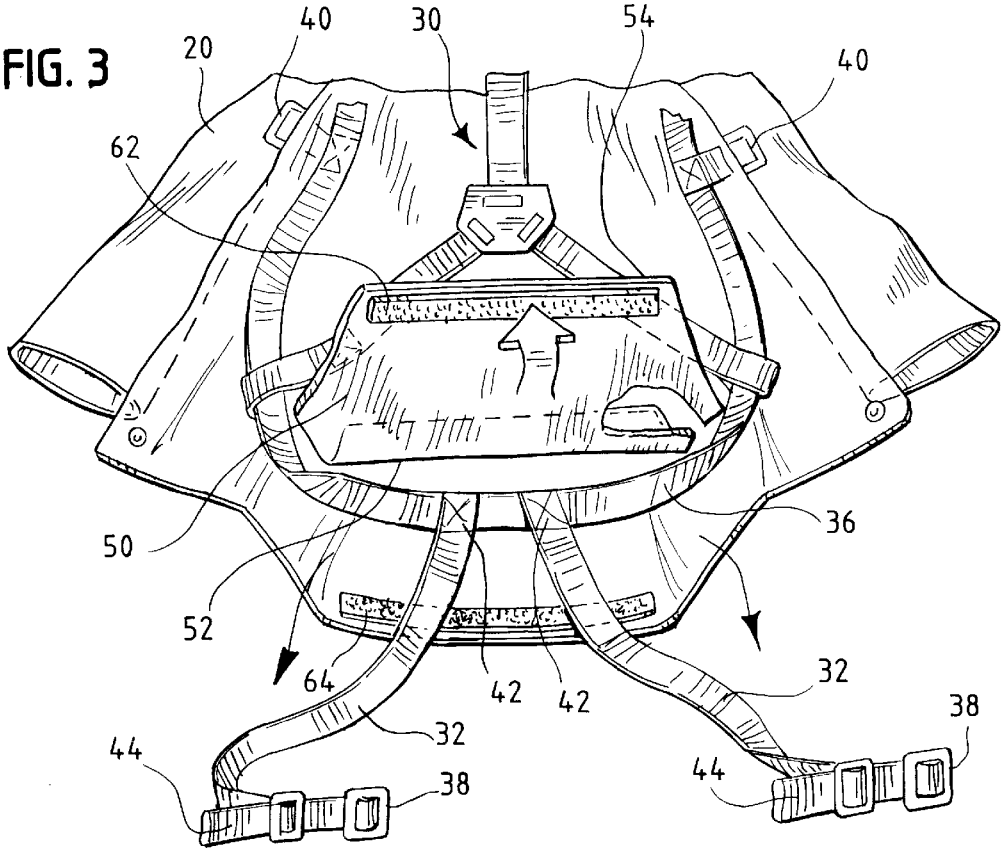
FIG. 3, on a larger scale compared to FIGS. 1 and 2, is a fragmentary, perspective view of the coat and harness combination, as viewed in FIG. 1, except that the thigh strap pocket has been opened and the thigh straps have been removed from the thigh strap pocket.
Figure 4:
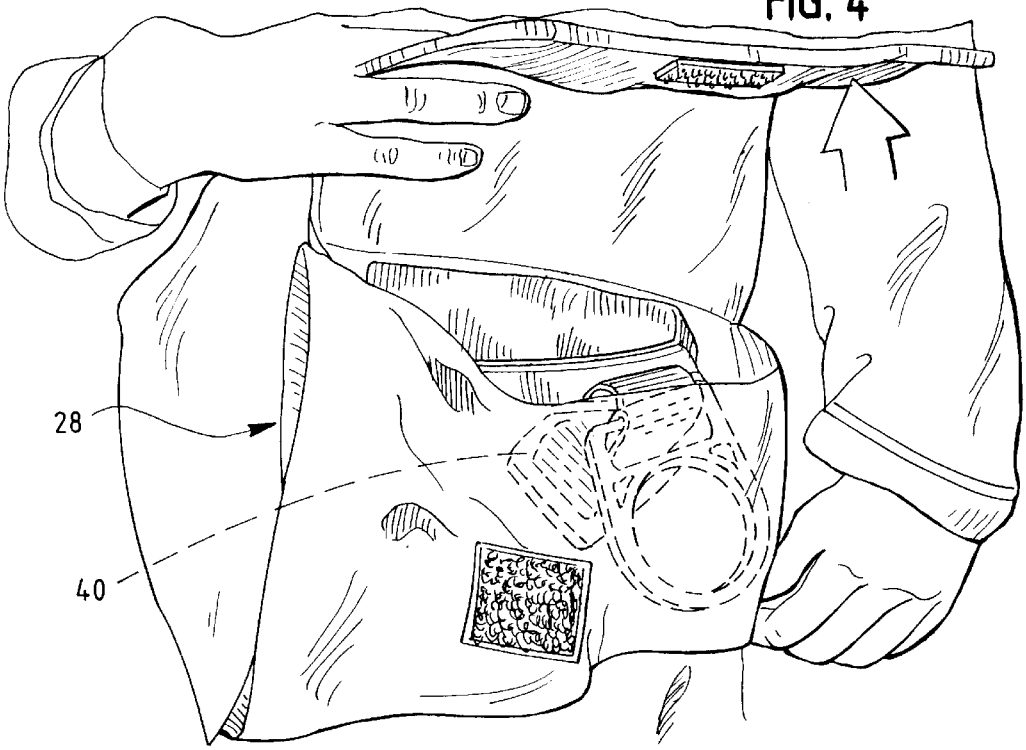
FIGS. 4 and 5, on a larger scale compared to FIG. 3, are fragmentary, perspective views, each illustrating a given one of two side pockets of the coat and each illustrating a connector, which is stowed in the same one of the side pockets.
Figure 5:
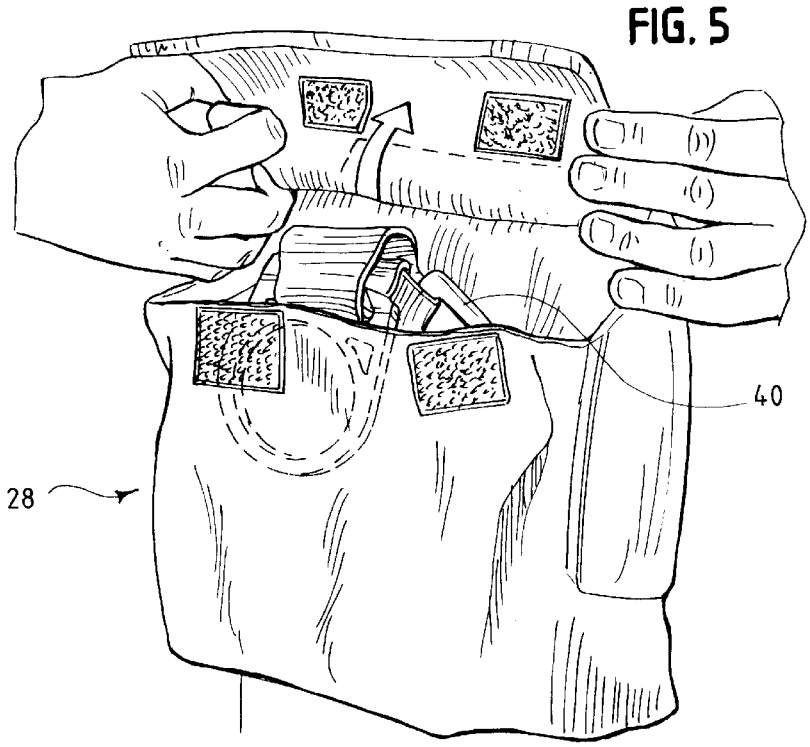
Figure 6:
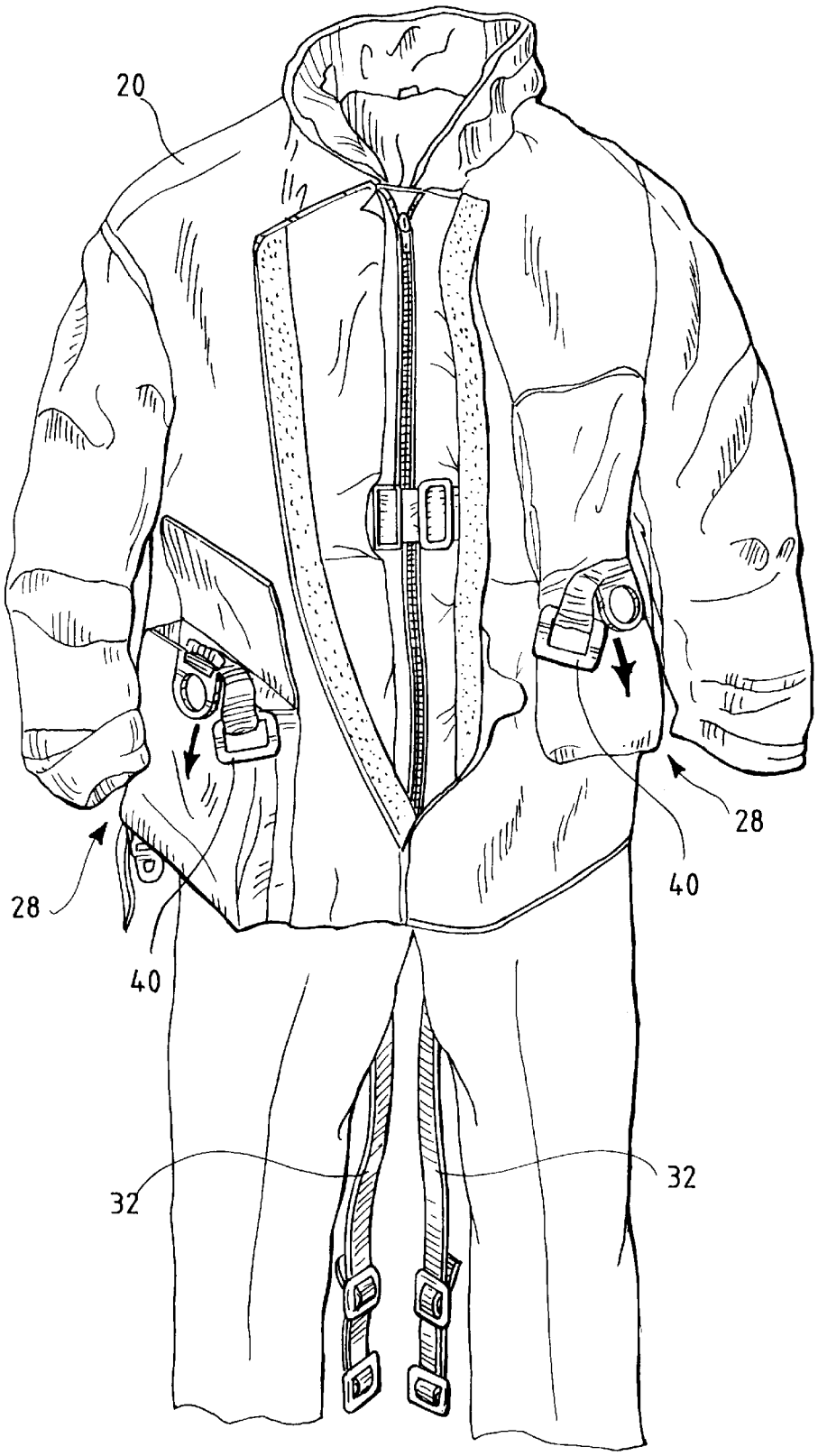
FIG. 6, on a similar scale, is a perspective view of the coat and harness combination, as worn with a pair of pants, the thigh straps having been removed from the thigh strap pocket, which is concealed in FIG. 6, and the connectors having been removed from the side pockets.
Figure 7:
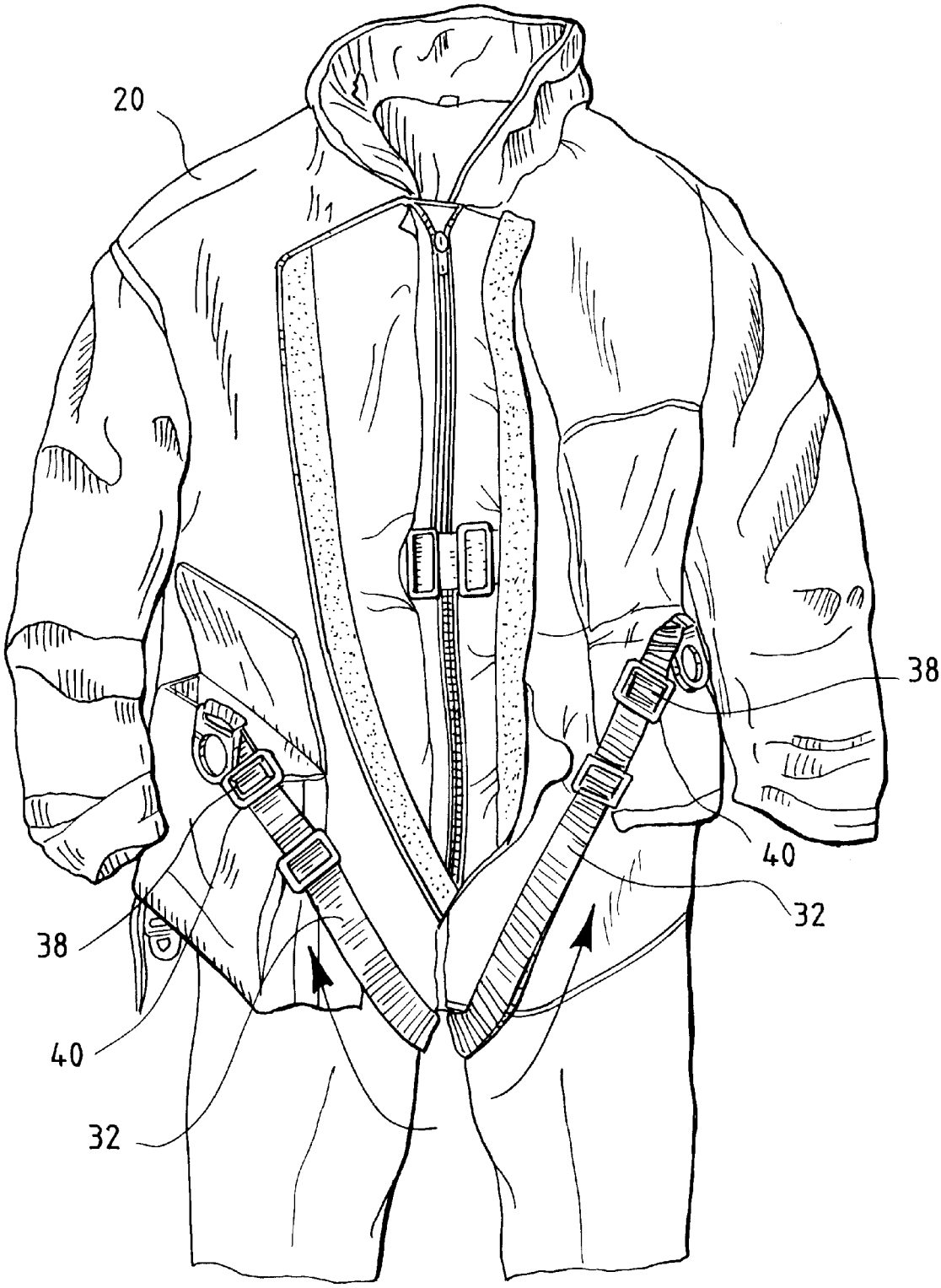
FIG. 7, on a similar scale, is a similar view, the thigh straps having been deployed between and around a wearer's thighs and having been attached detachably to the connectors.

As illustrated in FIG. 1 and in FIG. 3, the thigh strap pocket 26 is defined by a flap 50, which is sewn to and within the coat 20, preferably to and within the outer layer 22. The flap 50 has a first edge 52, along which the flap 50 is sewn thereto, along which the flap 50 is foldable to close the thigh strap pocket 26, as illustrated in FIG. 1, and to open the thigh strap pocket 26, as illustrated in FIG. 3. The flap 50 has a second edge 54, which is opposite to the first edge and along which the flap 50 is attachable detachably to and within the coat 20, preferably to and within the outer layer 22, when the thigh strap pocket 26 is closed.

Preferably, as illustrated, hook-and-loop fastening means 60, which comprise a hook-faced tape 62 sewn to and within the flap 50 and a loop-faced tape 64 sewn to and within the coat 20, are used to attach the flap 50 detachably to and within the coat 20. Alternatively, the hook-faced tape 62 and the loop-faced tape 64 are interchanged. Alternatively, other fastening means that are not illustrated, such as snap fasteners, buttons and buttonholes, or zippers, are used to attach the flap 50 detachably to and within the coat 20.

As mentioned hereinbefore, the thigh straps 32 are stowable in a thigh strap pocket 26 of the coat 20, when the thigh straps 32 are not deployed, and the connectors 40 are stowable in the side pockets 28 when the thigh straps 32 are not attached to the connectors 40. Advantageously, therefore, the thigh straps 32 do not have to be always deployed between and around a wearer's thighs whenever the firefighter's coat and harness combination 10 is worn.

What is claimed is:

1. A firefighter's coat and harness combination comprising a firefighter's coat, which has a thigh strap pocket being openable and closeable, and a firefighter's harness, which has two thigh straps, each thigh strap having a first end, at which said thigh strap is attached permanently to other portions of the harness, each thigh strap having a second end, at which said thigh strap is attachable detachably to other portions of the harness, wherein the thigh straps, while detached at their second ends, are stowable removably in the thigh strap pocket, and wherein the coat has a flap having a first edge and a second edge, the first edge being an upper edge when the coat is worn and the thigh strap pocket is closed and the second edge being a lower edge when the coat is worn and the thigh strap pocket is closed, the flap being foldable along the first edge, oppositely, to close the thigh strap pocket and to open the thigh strap pocket, the second edge being attachable detachably to a rear portion of the coat, when the thigh strap pocket is closed.

2. A firefighter's coat and harness combination comprising a firefighter's coat, which has a thigh strap pocket being openable and closeable, and a firefighter's harness, which has two thigh straps, each thigh strap having a first end, at which said thigh strap is attached permanently to other portions of the harness, at a rear portion of said combination, each thigh strap having a second end, at which said thigh strap is attachable detachably to other portions of the harness, at a front portion of said combination, wherein the thigh straps, while detached at their second ends, are stowable removably in the thigh strap pocket, and wherein the coat has a flap having a first edge and a second edge, the first edge being an upper edge when the coat is worn and the thigh strap pocket is closed and the second edge being a lower edge when the coat is worn and the thigh strap pocket is closed, the flap being foldable along the first edge, oppositely, to close the thigh strap pocket and to open the thigh strap pocket, the second edge being attachable detachably to a rear portion of the coat, when the thigh strap pocket is closed.

3. A firefighter's coat and harness combination comprising a firefighter's coat, which has a thigh strap pocket being openable and closeable, and a firefighter's harness, which has two thigh straps, each thigh strap having a first end, at which said thigh strap is attached permanently to other portions of the harness, each thigh strap having a second end, at which said thigh strap is attachable detachably to other portions of the harness, via a connector on said thigh strap and a connector interfitting with the connector on said thigh strap, wherein the thigh straps, while detached at their second ends, are stowable removably in the thigh strap pocket, wherein the connectors that interfit with the connectors on the thigh straps are stowable in the side pockets when the thigh straps are not attached at their second ends to the connectors, and wherein the coat has a flap having a first edge and a second edge, the first edge being an upper edge when the coat is worn and the thigh strap pocket is closed and the second edge being a lower edge when the coat is worn and the thigh strap pocket is closed, the flap being foldable along the first edge, oppositely, to close the thigh strap pocket and to open the thigh strap pocket, the second edge being attachable detachably to a rear portion of the coat, when the thigh strap pocket is closed.

4. A firefighter's coat and harness combination comprising a firefighter's coat, which has a thigh strap pocket being openable and closeable, and a firefighter's harness, which has two thigh straps, each thigh strap having a first end, at which said thigh strap is attached permanently to other portions of the harness, at rear portions of said combination, each thigh strap having a second end, at which said thigh strap is attachable detachably to other portions of the harness, at front portions of said combination, via a connector on said thigh strap and a connector interfitting with the connector on said thigh strap, wherein the thigh straps, while detached at their second ends, are stowable removably in the thigh strap pocket, wherein the connectors that interfit with the connectors on the thigh straps are stowable in the side pockets when the thigh straps are not attached at their second ends to the connectors and wherein the coat has a flap having a first edge and a second edge, the first edge being an upper edge when the coat is worn and the thigh strap pocket is closed and the second edge being a lower edge when the coat is worn and the thigh strap pocket is closed, the flap being foldable along the first edge, oppositely, to close the thigh strap pocket and to open the thigh strap pocket, the second edge being attachable, detachably to a rear portion of the coat, when the thigh strap pocket is closed.

5. The firefighter's coat and harness combination of claim 1, 2, 3, or 4 wherein the second edge of the flap is attachable detachably to the rear portion of the firefighter's coat via hook-and-loop fastening means.

* * * * *